US006842700B2

(12) United States Patent
Poe

(10) Patent No.: US 6,842,700 B2
(45) Date of Patent: Jan. 11, 2005

(54) METHOD AND APPARATUS FOR EFFECTIVE WELL AND RESERVOIR EVALUATION WITHOUT THE NEED FOR WELL PRESSURE HISTORY

(75) Inventor: Bobby D. Poe, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 44 days.

(21) Appl. No.: 10/447,421

(22) Filed: May 29, 2003

(65) Prior Publication Data

US 2003/0225522 A1 Dec. 4, 2003

Related U.S. Application Data

(60) Provisional application No. 60/384,795, filed on May 31, 2002.

(51) Int. Cl.[7] ..... G01V 9/00

(52) U.S. Cl. ..... 702/13

(58) Field of Search ..... 702/12, 13; 703/10

(56) References Cited

PUBLICATIONS

Everdingen, A.F. and Hurst, W., "*The Application of the Laplace Transformation to Flow Problems in Reservoirs*," Trans., AIME 186, 305–324 (1949).

Fetkovich, M.J., Fetkovich, E.J., and M.D. Fetkovich.; "*Useful Concepts for Decline Curve Forecasting, Reserve Estimation, and Anaylsis*," paper SPE 28628 presented at the SPE 69$^{th}$ Annual Technical conference and Exhibition held in New Orleans, LA Sep. 25–28, 1994, p. 217–232.

Poe, B.D. Jr., Conger, J.G., Farkas, R., Jones, B., Lee, K.K., and Boney, C.L.: "*Advanced Fractured Well Diagnostics for Production Data Analysis*," paper SPE 56750 presented at the 1999 Annual Technical Conference and Exhibition, Houston, TX, Oct. 3–6, p. 1–21.

Poe, B.D. Jr. and Marhaendrajana, T., "*Investigation of the Relationship Between the Dimensionless and Dimensional Analytic Transient Well Performance Solutions in Low–Permeability Gas Reservoirs*," paper SPE 77467 presented at the 2002 SPE Annual Technical Conference and Exhibition, San Antonio, TX, Sep. 29–Oct. 2, p. 1–11.

Doublet, L.E. Ct al.: "*Decline Curve Analysis Using Type Curves–Analysis of Oil Well Production Data Using Material Balance Time: Application to Field Cases*," paper SPE 28688 presented at 1994 Petroleum Conference and Exhibition of Mexico held in Veracruz, Mexico Oct. 10–13, 1994, p. 1–24.

Palacio, J.C. and Blasingame, T.A.: "*Decline–Curve Analysis Using Type Curves—Analysis of Gas Well Production Data*," paper SPE 25909 presented at the 1993 SPE Rocky Mountain Regional / Low Permeability Reservoirs Symposium, Denver, CO, Apr. 12–14, p. 1–13, figs. 1–21.

(List continued on next page.)

*Primary Examiner*—Donald McElheny, Jr.
(74) *Attorney, Agent, or Firm*—Stephen Schlather; Robin Nava

(57) ABSTRACT

A method for evaluating well performance includes deriving a reservoir effective permeability estimate from data points in a production history, wherein the data points include dimensional flow rates and dimensional cumulative production, at least one of the data points has no sand face flowing pressure information; and deriving at least one reservoir property from the reservoir effective permeability estimate and the data points according to a well type and a boundary condition for a well that produced the production data.

21 Claims, 8 Drawing Sheets

Agarwal, R.G., Gardner, D.C., Kleinsteiber, S.W., and Fussell, D.D.: "*Analyzing Well Production Data Using Combined Type Curve and Decline Curve Analysis Concepts*," SPE 49222 presented at the 1998 SPE Annual Technical conference andExhibition beld in New Orleans, LA Sep. 27–30 1998, p. 585–598.

Poe, B.D. Jr., Shah, P.C., and Elbel, J.L.: "*Pressure Transient Behavior of a Finite–Conductivity Fractured Well With Spatially Varying Fracture Properties*," paper SPE 24707 presented at the 1992 SPE Annual Technical Conference and Exhibition, Washington D.C., Oct. 4–7, p. 445–460.

Poe, Jr., B.D., "*Effective Well and Reservoir Evaluation without the Need for Well Pressure History*," SPE 77691, presented at the Annual Technical Conference and Exhibition held in San Antonio, TX, Sep. 22–Oct. 2, 2002, p. 1–15.

Fetkovich, M.J. "*Decline Curve Analysis Using Type Curves," JPT* (Jun. 1980) 1065–1077; Fetkovich, M.J. et al: "*Decline Curve Analysis Using Type Curves—Case Histories," SPEFE* (Dec. 1987)637–656.

Doublet, L.E. and Blasingame, T.A.: "*Decline Curve Analysis Using Type Curves*: Water lnflux/Waterflood Cases," paper SPE 30774 presented at the 1995 SPE Annual Technical Conference and Exhibition, Dallas, TX, Oct. 22–25, p. 1–23.

Shih, M.Y. and Blasingame, T.A.: "*Decline Curve Analysis Using Type Curves: Horizontal Wells" paper SPE 29572 presented at the 1995 SPE Rocky Mountain Regional and Low Permeability Reservoirs Symposium*, Denver, CO Mar. 19–22, 1995, p. 1–7, figs. 1–31.

Doublet, L.E. and Blasingame, T.A., "*Evaluation of Injection Well Performance Using Decline Type Curves*," paper SPE 35205 presented at the 1995 SPE Permian Basin Oil and Gas Recovery Conference, Midland, TX, Mar. 27–29, p. 1–39.

METHOD AND APPARATUS FOR EFFECTIVE WELL AND RESERVOIR EVALUATION WITHOUT THE NEED FOR WELL PRESSURE HISTORY

CROSS-REFERENCE TO RELATED APPLICATIONS

This invention claims priority pursuant to 35 U.S.C. § 119 of U.S. Provisional Patent Application Serial No. 60/384,795, filed on May 31, 2002. This Provisional Application is hereby incorporated by reference in its entirety.

STATEMENT REGARDING FEDERALLY SPONSORED RESEARCH OR DEVELOPMENT

Not applicable.

BACKGROUND OF INVENTION

1. Field of the Invention

The invention relates to methods and apparatus for analyzing reservoir properties and production performance using production data that do not have complete pressure history.

2. Background Art

To evaluate a well or reservoir properties, it is often necessary to analyze the production history of the well or reservoir. One of the most common problems encountered an oil or gas well production history analyses is the lack of a complete data record. The incomplete record makes it difficult to employ a conventional convolution analysis.

While the flow rates of the hydrocarbon phases (oil and gas) of a well are generally known with reasonable accuracy, well flowing pressure is commonly not recorded or the record of the flowing pressure is often incomplete. Unfortunately, the flowing pressure is required for the conventional convolution analysis.

Due to the lack of complete pressure history, prior art methods (e.g., conventional convolution analyses) for the evaluation of well or reservoir properties often fail. Therefore, it is desirable to have methods and apparatus that can perform well or reservoir evaluation using data points that may not all have sand face pressure information.

SUMMARY

One aspect of the invention relates to methods for evaluating well performance. A method for evaluating well performance in accordance with the invention includes deriving a reservoir effective permeability estimate from data points in a production history, wherein the data points include dimensional flow rates and dimensional cumulative production, at least one of the data points has no sand face flowing pressure information; and deriving at least one reservoir property from the reservoir effective permeability estimate and the data points according to a well type and a boundary condition for a well that produced the production data Another aspect of the invention relates to methods for evaluating well performance. A method for evaluating well performance in accordance with the invention includes deriving dimensionless flow rates and dimensionless cumulative production from dimensional flow rates and dimensional cumulative production data in a production history, wherein at least one data point in the production history includes pressure information and the deriving is based on a well type and a boundary condition; fitting a curve representing the dimensionless flow rates as a function of the dimensionless cumulative production to a plot of the dimensional flow rates versus the dimensional cumulative production; and obtaining a formation effective permeability estimate from the fitting.

Another aspect of the invention relates to methods for evaluating well performance. A method for evaluating well performance in accordance with the invention includes deriving a reservoir effective permeability estimate from early data points in a production history, the data points include dimensional flow rates and dimensional cumulative production, wherein no data point in the production history has sand face flowing pressure information, and the deriving is based on a model of an unfractured vertical well having an infinite-acting reservoir; and deriving at least one reservoir property from the reservoir effective permeability estimate and the production data according to a well type and a boundary condition for a well that produced the production data.

Another aspect of the invention relate to systems for evaluating well performance. A system for evaluating well performance in accordance with the invention includes a computer having a memory for storing a program, wherein the program includes instructions to perform: deriving a reservoir effective permeability estimate from data points in a production history, wherein the data points include dimensional flow rates and dimensional cumulative production, at least one of the data points has no sand face flowing pressure information; and deriving at least one reservoir property from the reservoir effective permeability estimate and the data points according to a well type and a boundary condition for a well that produced the production data.

Other aspects and advantages of the invention will be apparent from the following description and the appended claims.

DETAILED DESCRIPTION

Embodiments of the invention relate to methods and systems for evaluating well or reservoir properties based on production history data. Methods according to the invention may be used in cases where pressure history is incomplete or is completely missing.

The symbols used in this description have the following meanings:

Nomenclature

A Well drainage area, $ft^2$ $A_D$ Dimensionless drainage area, $A_D=A/L_C^2$
$b_f$ Fracture width, ft
$B_o$ Oil formation volume factor, rb/STB
$C_{fD}$ Dimensionless fracture conductivity, $C_{fD}=k_f b_f/kX_f$
$C_t$ Reservoir total system compressibility, 1/psia
$C_{tf}$ Fracture total system compressibility, 1/psia
$f_{BF}$ Cumulative production bilinear flow superposition time function
$f_{BF1}$ Flow rate bilinear flow superposition time function
$f_{FL}$ Cumulative production formation linear flow superposition time function
$f_{FL1}$ Flow rate formation linear flow superposition time function
$f_{FS}$ Cumulative production fracture storage linear flow superposition time function
$f_{FS1}$ Flow rate fracture storage linear flow superposition time function
$G_p$ Cumulative gas production, MMscf
h Reservoir net pay thickness, ft
$k_f$ Fracture permeability, md
$k_g$ Reservoir effective permeability to gas, md
$k_o$ Reservoir effective permeability to oil, md
$L_C$ System characteristic length, ft
$L_D$ Dimensionless horizontal well length in pay zone, $$L_D=L_h/2h$$

Figure 1:
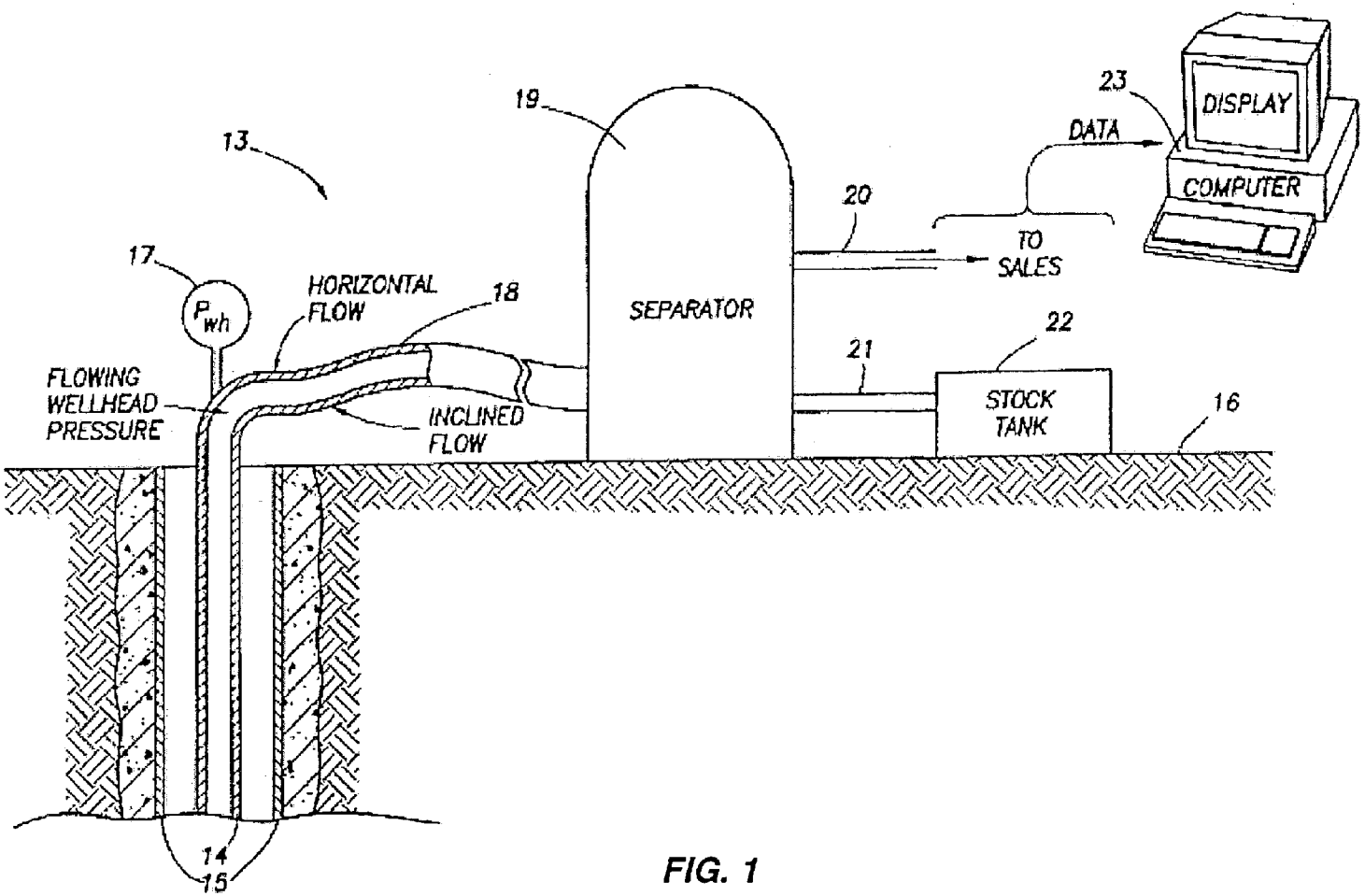
FIG. 1 (Prior Art)
FIG. 1 shows a prior art production analysis system for evaluating well or reservoir properties.

$L_h$ Effective horizontal well length in pay zone, ft
m Summation index
n Index of current or last data point
$N_p$ Cumulative oil production, STB
$p_D$ Dimensionless pressure solution
$p_{Di}$ Dimensionless pressure at the ith time level
$p_i$ Initial reservoir pressure, psia
$p_p$ Real gas pseudopressure potential, $psia^2/cp$
$p_{sc}$ Standard condition pressure, psia
$p_{wD}$ Dimensionless well bore pressure
$p_{wf}$ Sand face flowing pressure, psia
$q_D$ Dimensionless flow rate
$q_g$ Gas flow rate, Mscf/D
$q_o$ Oil flow rate, STB/D
$Q_{pD}$ Dimensionless cumulative production
$q_{wD}$ Dimensionless well flow rate
$r_e$ Effective well drainage radius, ft
$r_{eD}$ Dimensionless well drainage radius, $r_{eD}=r_e/L_C$
$r_w$ Well bore radius, ft
$r_{wD}$ Dimensionless well bore radius, $r_{wD}=r_w/h$
T Reservoir temperature, deg R
$t_a$ Pseudotime integral transformation, hr-psia/cp
$t_{ae}$ Equivalent pseudotime superposition function, hr-psia/cp
$t_{amb}$ Gas reservoir "material balance" time, hr
$t_D$ Dimensionless time
$t_{Di}$ ith dimensionless time in production history
$t_e$ Equivalent time superposition function, hr
$t_i$ ith time level in production history, hr
$t_{mb}$ Oil reservoir "material balance" time, hr
$t_n$ Last or current time level in production history, hr
$T_{SC}$ Standard condition temperature, deg R
$X_D$ Dimensionless X direction spatial position
$X_D$* Dimensionless fracture spatial position
$X_{eD}$ Dimensionless X direction drainage areal extent
$X_f$ Effective fracture half-length, ft
$X_{wD}$ Dimensionless X direction well spatial position
$Y_D$ Dimensionless Y direction spatial position
$Y_{eD}$ Dimensionless Y direction drainage areal extent
$Y_{wD}$ Dimensionless Y direction well spatial position
$Z_{wD}$ Dimensionless well vertical spatial position
Greek
β Dimensionless parameter
ξ Dimensionless parameter
φ Reservoir effective porosity, fraction BV
$\phi_f$ Fracture effective porosity, fraction BV
σ Pseudoskin due to dimensionless fracture conductivity
δ Pseudoskin due to bounded nature of reservoir
$\eta_{fD}$ Dimensionless fracture hydraulic diffusivity
$\mu_{gCt}$ Mean value gas viscosity-total system compressibility, cp/psia
$\mu_o$ Oil viscosity, cp
Functions
erfc Complimentary error function
exp Exponential function
ln Natural logarithmic function FIG. 1 provides an overview of a production analysis system 13 having a production tubing 14 within a casing 15. The wellbore extends up to the ground surface 16, and a flowing wellhead pressure is measured by a wellhead pressure gauge 17. Production piping 18 carries oil and gas to a separator 19, which separates oil and gas. Gas moves along gas line 20, to be sold into a pipeline, while oil moves along oil line 21 to a stock tank 22. Data representing amounts of oil and/or gas produced is provided to a computer 23 for display, printing, or recordation. Data may include flow rates, pressures (sand face pressure, wellhead pressure, or bottom hole pressure), and cumulative production information of the well.

The effect of a varying flow rate and sand face flowing pressure of a well on the dimensionless wellbore pressure at a point in time of interest has been established with the Faltung Theorem. See van Everdingen, A. F. and Hurst, W., "*The Application of the Laplace Transformation to Flow Problems in Reservoirs*," Trans., AIME 186, 305–324 (1949). The general form of the well-known convolution relationship that accounts for the superposition-in-time effects of a varying sand face pressure and flow rate on the dimensionless wellbore pressure transient behavior of a well is given by Eq. 1. For more detailed description of the equations presented herein see the attached Appendix.

$$p_{wD}(t_D) = \int_0^{t_D} q_D(\tau) p'_D(t_D - \tau)\, d\tau \tag{1}$$

The pressure transient behavior of a well with a varying flow rate and pressure can be readily evaluated using Eq. 1 for specified terminal flow rate (Neumann) inner boundary condition transients (such as constant flow rate drawdown or injection transients) or shut-in well sequences (such as pressure buildup or falloff transients). The most appropriate inner boundary condition for the analysis of production history of a well is that of a specified terminal pressure (Dirichlet) inner boundary condition.

The dimensionless rate-transient behavior corresponding to a specified terminal pressure inner boundary condition of a well with a varying flow rate and sand face pressure is given in Eq. 2. See Poe, B. D. Jr., Conger, J. G., Farkas, R., Jones, B., Lee, K. K., and Boney, C. L.: "*Advanced Fractured Well Diagnostics for Production Data Analysis*," paper SPE 56750 presented at the 1999 Annual Technical Conference and Exhibition, Houston, Tex., October 3–6.

$$q_{wD}(t_D) = -\int_0^{t_D} q_D(t_D - \tau) p'_D(\tau)\, d\tau \tag{2}$$

With a substitution of variables, this rate-transient convolution integral can be converted to a more amenable form presented in Eq. 3.

$$q_{wD}(t_D) = -\int_0^{t_D} p_D(\tau) q_D'(t_D - \tau)\, d\tau - q_D(0) \tag{3}$$

From the pressure-transient (Eq. 1) or rate-transient (Eq. 3) convolution integral for the varying flow rate and sand face pressure of a well, a discrete time approximation of the convolution integral may be derived to permit the analysis of a varying flow rate and sand face pressure production history. For example, the corresponding rate-transient convolution integral approximation of a dimensionless well flow rate is given in Eq. 4.

$$q_{wD}(t_{Dn}) = \sum_{\substack{i=1 \\ n>1}}^{n-1} p_{Di}[q_D(t_{Dn} - t_{Di-1}) - q_D(t_{Dn} - t_{Di})] + q_D(t_{Dn} - t_{Dn-1}) \tag{4}$$

Similarly, the corresponding rate-transient solution dimensionless cumulative production of a well with a varying flow rate and sand face pressure production history can also be evaluated using a discrete time approximation as shown in Eq. 5. See Poe, B. D. Jr., Conger, J. G., Farkas, R., Jones, B., Lee, K. K., and Boney, C. L.: "*Advanced Fractured Well Diagnostics for Production Data Analysis*," paper SPE 56750 presented at the 1999 Annual Technical Conference and Exhibition, Houston, Tex., October 3–6.

$$Q_{pD}(t_{Dn}) = \sum_{\substack{i=1 \\ n>1}}^{n-1} p_{Di}[Q_{pD}(t_{Dn} - t_{Di-1}) - Q_{pD}(t_{Dn} - t_{Di})] + Q_{pD}(t_{Dn} - t_{Dn-1}) \tag{5}$$

The dimensionless parameters (e.g., pressure, flow rate, cumulative production, and time) in above equations may be defined in terms of conventional oilfield units as follows. The dimensionless pressures appearing in the superposition-in-time relationships of Eqs. 4 and 5 for oil and gas reservoirs may be defined as in Eqs. 6 and 7, respectively.

$$p_{Di} = \frac{p_i - p_{wf}(t_i)}{p_i - p_{wf}(t_n)} \tag{6}$$

$$p_{Di} = \frac{p_p(p_i) - p_p(p_{wf}(t_i))}{p_p(p_i) - p_p(p_{wf}(t_n))} \tag{7}$$

The wellbore dimensionless flow rates for oil and gas reservoirs may be defined in conventional oilfield units as in Eqs. 8 and 9, respectively.

$$q_{wD} = \frac{141.205 q_o(t) \mu_o B_o}{k_o h(p_i - p_{wf})} \tag{8}$$

$$q_{wD} = \frac{50299.5 p_{sc} T q_g(t)}{k_g h T_{sc}(p_p(p_i) - p_p(p_{wf}))} \tag{9}$$

The dimensionless cumulative production of oil and gas reservoirs may also be defined in conventional oilfield units as in Eqs. 10 and 11, respectively.

$$Q_{pD}(t_n) = \frac{N_p(t_n) B_o}{1.11909 \phi c_t h L_c^2 (p_i - p_{wf}(t_n))} \tag{10}$$

-continued $$Q_{pD}(t_n) = \frac{318313 p_{sc} T G_p(t_n)}{\phi h \overline{\mu_g c_t}(t_n) T_{sc} L_c^2 (p_p(p_i) - p_p(p_{wf}(t_n)))} \tag{11}$$

The dimensionless time corresponding to a given value of dimensional time ($t_n$) for oil and gas reservoir analyses is defined in Eqs. 12 and 13, respectively.

$$t_D(t_n) = \frac{0.000263679\, k_o t_n}{\phi \mu_o c_t L_c^2} \tag{12}$$

$$t_D(t_n) = \frac{0.000263679\, k_g t_a(t_n)}{\phi L_c^2} \tag{13}$$

The system characteristic length ($L_c$) in Eqs. 10 through 13 depends on the system under consideration. In an unfractured vertical well, the system characteristic length ($L_c$) may equal the wellbore radius (half the wellbore diameter). However, the system characteristic length ($L_c$) may not necessarily equal to the hole size. An apparent (or effective) wellbore radius is also commonly used as the system characteristic length in unfractured vertical well decline analyses, particularly in cases where the well has been stimulated to improve its productivity. The stimulation results in a negative steady state skin effect. In this case, the apparent wellbore radius (or the system characteristic length, $L_c$) is the wellbore radius multiplied by an exponential function of the negative value of the steady state skin effect.

In a vertically fractured well analysis, the system characteristic length ($L_c$) is the fracture half-length (or half of the total effective fracture length) in the system. Similarly, in a horizontal well analysis, the system characteristic length ($L_c$) is equal to half of the total effective wellbore length in the pay zone.

Methods for the evaluation of the pseudotime integral transformation are known in the art. However, care should be taken in analyzing low-permeability gas reservoir so that this integral transformation is accurately and properly evaluated. See Poe, B. D. Jr. and Marhaendrajana, T., "*Investigation of the Relationship Between the Dimensionless and Dimensional Analytic Transient Well Performance Solutions in Low-Permeability Gas Reservoirs*," paper SPE 77467 presented at the 2002 SPE Annual Technical Conference and Exhibition, San Antonio, Tex., September 29–October 2.

With these rate-transient analysis fundamental relationships established, it is now a practical means may be developed for estimating the superposition-in-time function values of production history data points for which (or some of which) the flowing sand face (or wellhead) pressure are not available. For a production history data point that has the flowing wellhead pressure and well flow rates recorded, the corresponding bottom hole wellbore and sand face flowing pressures may be estimated using the industry-accepted wellbore pressure traverse and completion pressure loss models. *See The Technology of Artificial Lift Methods*, Brown, K. E. (ed.), 4 PennWell Publishing Co., Tulsa, Okla. (1984).

When the wellhead flowing pressure is not available at a production data point, and bottom hole pressure measurements are also not available, a conventional convolution analysis of the type prescribed by Eqs. 4 and 5 is not possible without guessing (or in some way roughly estimating) what the missing sand face flowing pressure should have been at that point in time in the production history.

Palacio and Blasingame proposed an alternative solution to this problem based on the "material balance" time function of McCray. See Palacio, J. C. and Blasingame, T. A.: "*Decline-Curve Analysis Using Type Curves—Analysis of Gas Well Production Data*," paper SPE 25909 presented at the 1993 SPE Rocky Mountain Regional/Low Permeability Reservoirs Symposium, Denver, Colo., April 12–14. The "material balance" equivalent time function is similar to the Horner approximation that is commonly used in the evaluation of the pseudo-producing time of a smoothly varying flow rate history in pressure buildup analyses. From pressure-transient theory, Palacio and Blasingame showed that during a pseudo-steady state flow regime (fully boundary dominated flow in a closed system), the "material balance" time function equals the rigorous superposition-in-time relationship for the pressure-transient For rate-transient analyses, the "material balance" time approximation may be defined for oil reservoir analyses, as shown in Eq. 14. This "material balance" time approximation for rate-transient analyses is identical in form to the "material balance" time function reported by Palacio and Blasingame. In the rate-transient case, the exact relationship between the flow rate and cumulative production functions change with each flow regime as a function of time.

$$t_{mb}(t_n) = \frac{24N_p(t_n)}{q_o(t_n)} \tag{14}$$

From an equivalent "material balance" time function analogous to that described by Palacio and Blasingame for pressure-transient analyses (instead of that developed for rate-transient analyses of the production performance of gas reservoirs), a "material balance" time function may be defined for gas reservoir analyses, as shown in Eq. 15.

$$t_{amb}(t_n) = \frac{24000G_p(t_n)}{q_g(t_n)} \tag{15}$$

While the "material balance" time function has been shown to have a theoretical basis for the pressure-transient behavior of a well during the pseudo-steady state flow regime, it should not be used to analyze any other pressure-transient flow regime, nor any rate-transient flow regime. However, many prior art references have missed this important point and improperly used the "material balance" time function in the analysis of the production performance of flow regimes other than the pseudo-steady-state flow regime.

Figure 2:
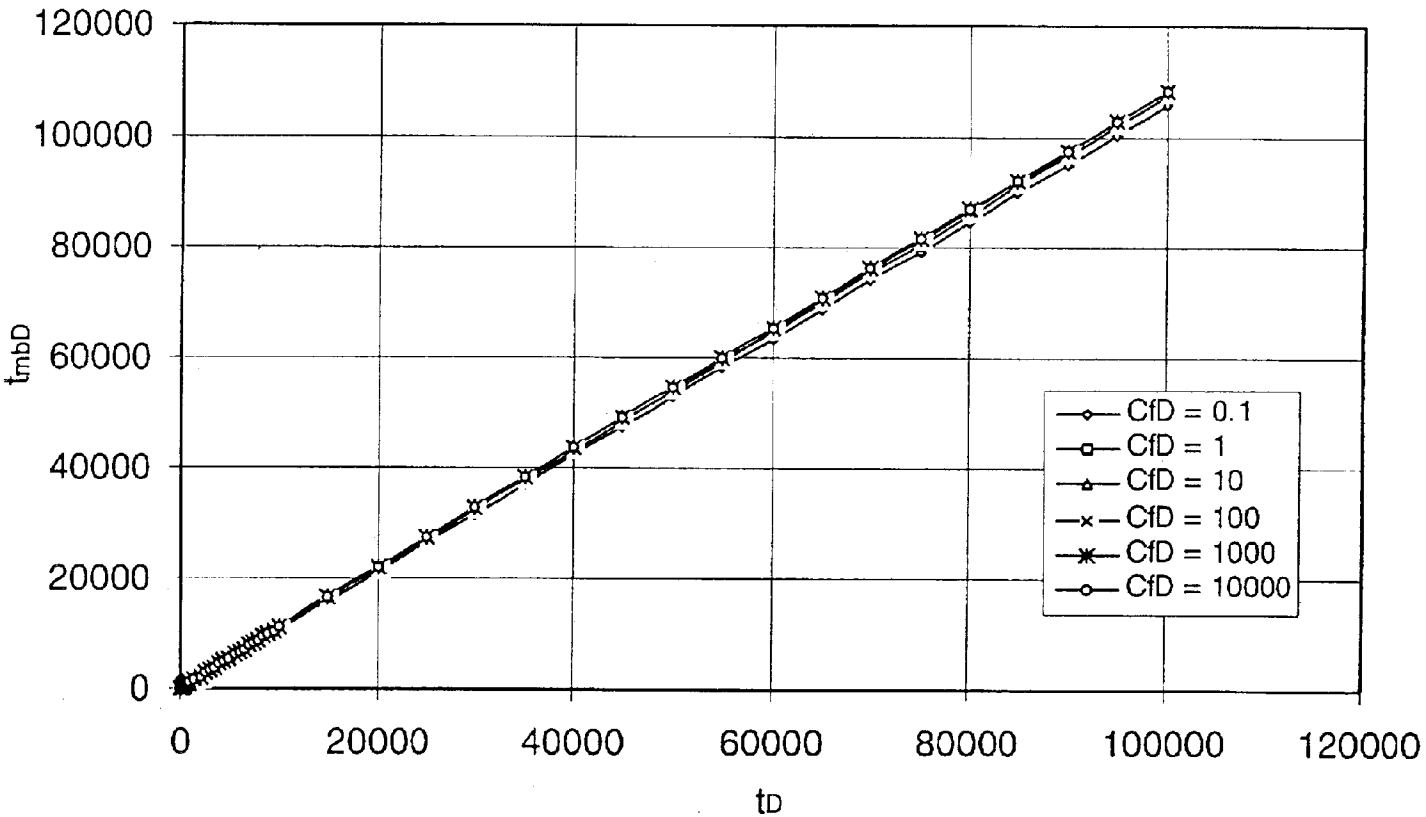
FIG. 2 shows a graph of formation analysis using a conventional convolution method.

For example, Agarwal et al. have erroneously reported that the rate-transient and pressure-transient solutions are equivalent. See Agarwal, R. G., Gardner, D. C., Kleinsteiber, S. W., and Fussell, D. D.: "*Analyzing Well Production Data Using Combined Type Curve and Decline Curve Analysis Concepts*," SPE Res. Eval. and Eng., (October 1999) Vol. 2, No. 5, 478–486. They show several simulation results from comparison between the "material balance" time function and the equivalent superposition-in-time function, one of which is shown in FIG. 2 for a vertically fractured well. FIG. 2 shows that "material balance" times ($t_{mbD}$) linearly correlate with equivalent superposition times ($t_D$) for various formation conductivities ($C_{fD}$ from 01 to 10,000). The apparently linear correlation seems to support the proposition that the rate-transient and pressure-transient solutions are equivalent. However, when the same data are replotted as a ratio of "material balance" time ($t_{mbD}$) to the equivalent superposition time ($t_D$) versus the equivalent superposition time ($t_D$), the non-equivalency between the rate-transient and pressure-transient solutions becomes apparent, as shown in FIG. 3.

The improper application of the "material balance" time function has led to fundamental inconsistency in several reports in the field. The inconsistency arises from the use of the "material balance" time function that is derived from pressure-transient theory for only the pseudo-steady state flow regime in the analysis of the rate-transient performance of wells that do not belong to the pseudo-steady state flow regime. These reports typically use the conventional flow rate decline curve (rate-transient) solutions in some form to evaluate the production behavior of oil and gas wells. However, it is known that the uncorrected "material balance" time function is not suitable for any rate-transient solution flow regime, not even for fully boundary-dominated flow.

In contrast, methods in accordance with the invention are internally consistent in that they use a "material balance" time function derived directly from rate-transient theory and use the appropriate rate-transient solutions for all of the analyses. Accordingly, embodiments of the invention provide a consistent methodology for the analysis of production performance data of oil and gas wells.

Figure 3:
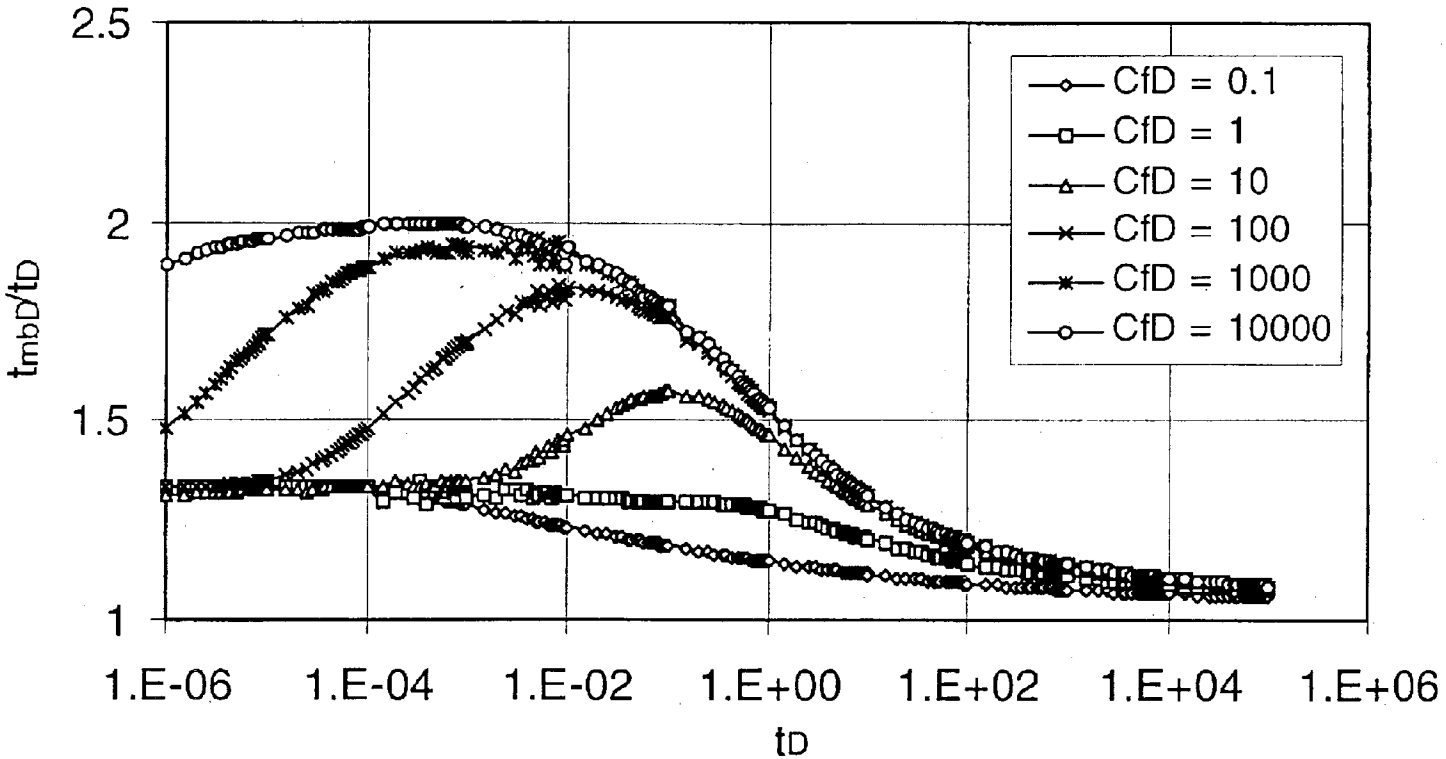
FIG. 3 shows a variation of a graph of formation analysis using a conventional convolution method.

The results presented in FIGS. 2 and 3 were generated using a reservoir simulator constructed with the complete, rigorous, Laplace domain, rate-transient, analytic solution of a finite-conductivity vertical fracture in an infinite-acting reservoir. See Poe, B. D. Jr., Shah, P. C., and Elbel, J. L.: "*Pressure Transient Behavior of a Finite-Conductivity Fractured Well With Spatially Varying Fracture Properties*," paper SPE 24707 presented at the 1992 SPE Annual Technical Conference and Exhibition, Washington D.C., Oct. 4–7. Bounded reservoir solutions have also been generated in this study to verify these results and findings. These results have also been duplicated with a commercial finite-difference reservoir simulator such as the General Purpose Petroleum Reservoir Simulator, sold under the trade name of SABRE™ by S. A. Holditch & Associates, Inc. (College Station, Tex.).

The bounding limits for each of the flow regimes are easily identified from FIG. 3. It is clear from FIG. 3 that the "material balance" to superposition time ratio has a constant value of 4/3 during the bilinear flow regime. During the formation linear flow regime, the ratio of the "material balance" time to the superposition time reaches a constant value of 2 (which is a maximum on the graph). Not only are these two time functions not equivalent, but the ratio between the two functions also varies continuously over the transient history of the well.

An earlier flow regime (fracture storage or fracture linear flow regime) also exists in the transient behavior of a vertically fractured well but is not depicted in FIGS. 2 and 3 because this flow regime (1) ends very quickly (in much less time than is generally recorded as the first data point in production data records), and (2) is commonly "masked" or distorted by wellbore storage (only applicable for pressure-transient solutions) even if it is present. During the fracture linear flow regime, the ratio of the "material balance" to the equivalent superposition time also has a constant value of 2.

A late time flow regime may also exist for all types of wells (unfractured vertical, vertically fractured, and horizontal wells) in closed (no flow outer boundary condition) systems. The late time flow regime is also not depicted in FIGS. 2 and 3. In rate-transient analyses, this flow regime is simply referred to as the fully boundary-dominated flow regime. It occurs during the same interval in time as the pseudo-steady state flow regime of pressure-transient solutions, but the pressure distributions in the reservoir during the boundary-dominated flow regime of rate-transient solutions are completely different from those exhibited in pressure-transient solutions. Description for the rate-transient behavior of oil and gas wells during the boundary-dominated flow regime may be found in Poe, Jr., B. D., "*Effective Well and Reservoir Evaluation without the Need for Well Pressure History*," SPE 77691, presented at the Annual Technical Conference and Exhibition held in San Antonio, Tex., 22 Sep.–2 Oct. 2002.

Even during the radial flow regime of unfractured vertical wells (analogous to the pseudoradial flow regime of vertically fractured wells), the ratio of the "material balance" time function to the equivalent superposition time function has a value of about 1.08, as shown in FIG. 3. Thus, for a radial (or pseudoradial) flow analysis, an error in the time function is about 8%, which may be acceptable. However, errors in the time function may be as much as 200% during the formation linear (or pseudolinear) flow regime of vertically fractured wells.

The rate-transient (flow rate or cumulative production versus time) decline curve solutions have been widely used in production data analyses and have been shown to be appropriate for most cases. Fetkovich and co-workers have greatly expanded the use and applicability of the decline curve analyses to the characterization of formation and well properties from production performance data of oil and gas wells. See Fetkovich, M. J. "*Decline Curve Analysis Using Type Curves*," JPT (June 1980) 1065–1077; Fetkovich, M. J. et al: "*Decline Curve Analysis Using Type Curves—Case Histories*," SPEFE (December 1987) 637–656. Blasingame and co-workers have also reported the development of production analyses using decline curves that also incorporate the use of the "material balance" time function. See e.g., Doublet, L. E. and Blasingame, T. A.: "*Decline Curve Analysis Using Type Curves: Water Influx/Waterflood Cases*," paper SPE 30774 presented at the 1995 SPE Annual Technical Conference and Exhibition, Dallas, Tex., October 22–25.

If the proper corrections (see later discussion related to Eq. (16)) are made to the "material balance" time function, a modified "material balance" time function can be constructed and used to obtain an "effective" time function value that is equivalent in magnitude to the rigorous superposition time function. This type of equivalent time function would permit the analysis of production history data points for which the flowing pressures are not known. Therefore, a convolution analysis of all of the production history is performed, using the known pressure data points where they exist in a conventional convolution analysis, and using the modified "material balance" time function to evaluate the equivalent superposition time function values that correspond to the data points at which the pressures are not known. This approach is used to construct the model described in the following section.

Model Description

Embodiments of the invention relate to a production analysis model that combines the conventional rate-transient convolution analysis (which is for production data points with known pressures) with the modified "material balance" time concept (which is for data points without known pressure) into a robust and accurate production analysis system. A production analysis system in accordance with the invention is referred to as a Pressure Optional Effective Well And Reservoir Evaluation (POEWARE) production analysis system.

A production analysis system according to embodiments of the invention may be constructed by generating and storing the rate-transient decline curve solutions for a family of well types, outer boundary conditions, and for a range of parameter values that relate to the model under consideration. The dependent variables that are required in the solution are the dimensionless well flow rate and cumulative production as a function of time. Rate-transient decline curves of this type are generated and stored for a practical range of the independent variable values.

For unfractured vertical well rate-transient type curves, the independent variables are dependent on the outer boundary condition specified. In a closed cylindrically bounded reservoir, the dimensionless well drainage radius ($r_{eD}$), referenced to the apparent wellbore radius, is the independent variable for generating a family of rate-transient decline type curves. In an infinite-acting reservoir system, the radial flow steady-state skin effect is the independent variable for constructing the family of type curves. The latter set is of particular importance for all well types (unfractured, fractured, and horizontal) where no sand face flowing pressures are available for the convolution analysis. The details of this procedure will be discussed in the following section.

For vertically fractured wells in infinite-acting reservoirs, the independent variable of interest is the dimensionless fracture conductivity ($C_{fD}$). In closed reservoirs, the fractured well decline curves are also constructed with the dimensionless well drainage area ($A_D$) as an independent variable.

For horizontal well decline curves, a larger number of independent parameter values must be considered. In infinite-acting systems, the dimensionless wellbore length ($L_D$), vertical location in the pay zone ($Z_{wD}$), and wellbore radius ($r_{wD}$) are all considered. The effect of the wellbore location has been demonstrated by Ozkan to have a lesser impact on the wellbore transient behavior than the dimensionless wellbore length and wellbore radius and may be fixed at a constant average value (equal to approximately one half) if limitations of array storage and interpolation are encountered. See Ozkan, E.: *Performance of Horizontal Wells*, Ph.D. dissertation, University of Tulsa, Tulsa, Okla. (1988). In a finite closed reservoir, the dimensionless well drainage area ($A_D$) should also be included in the independent variables when generating that family of decline curves.

While the above described production analysis models only consider the common well types and outer boundary conditions, the analysis methodology is generally applicable. One of ordinary skill in the art would appreciate that a numerical simulation model according to embodiments of the invention may be applied to any well and reservoir configuration, and the resulting rate-transient decline curves may then be used in the analysis. The only requirement of a production analysis methodology in accordance with embodiments of the invention is that the dimensionless flow rate and cumulative production transient behavior of the particular well and reservoir configuration under consideration can be accurately generated and stored for use in the decline curve analysis.

The evaluation of the ratio of the "material balance" time function to the rigorous equivalent superposition-in-time function, as a function of the equivalent superposition time, is defined in its most fundamental form for rate-transient analyses in Eq. 16.

$$\frac{t_{mb}(t_n)}{t_e(t_n)} = \frac{t_{Dmb}(t_n)}{t_D(t_n)} = \frac{Q_{pD}(t_n)}{q_{wD}(t_n)t_D(t_n)} \tag{16}$$

Note that Eq. 16 directly provides the necessary correction for the conventional "material balance" time function. Therefore, the dimensionless time, flow rate, and cumulative production obtained for any well type and reservoir configuration may be used to compute the correction for the "material balance" time function over the entire transient history of the well. The modified "material balance" equivalent time function that is used to perform the convolution for production data points, for which the sand face pressures are unknown, is obtained by simply dividing the appropriate uncorrected "material balance" time function value (given by Eqs. 14 or 15) by the correction defined with Eq. 16. Therefore, the superposition time function value can be effectively (and internally consistently) estimated using the "material balance" time function (computed from well production data) and the decline curve analysis matched well and reservoir model dimensionless rate-transient behavior. The actual implementation and application of this new technology in the model is discussed in the following section.

Implementation and Application

The production analysis methods in accordance with embodiments of the invention may be separated into two categories. Each of these categories is considered separately, because each requires a different solution procedure.

Methods in the first category are applicable to cases in which at least one production data point (at any point in time during the entire production history of the well) has a known flowing sand face pressure associated with the corresponding flow rate data point. If no sand face pressure is available, wellhead flowing pressure (or possibly bottom hole flowing wellbore pressure measurements from permanent downhole gauges) may be used instead, if there is negligible completion pressure loss in the system. Because completion losses in general depend on formation effective permeability (and skin effect in some models), simultaneous solution of the sand face flowing pressure, the formation effective permeability, and skin effect generally requires an iterative procedure. Thus, the first case requires that the sand face flowing pressure for at least one point in time in the production history be known (or that the completion losses can be ignored and the sand face flowing pressures can be assumed from the well head or bottom hole wellbore flowing pressure). With this case, a fully determined system can be directly solved at each of the production data time levels with known sand face flowing pressures. If the production data set and the well conditions do not meet these requirements, then methods in the second category (described below) should be used.

Methods in the second category involve a two-step or iterative evaluation procedure to estimate the well and reservoir properties. The two step or iterative approach is necessary because no sand face pressure is available for any data point to perform the decline curve matching and formation effective permeability estimation as outlined above. The first step involves a decline curve analysis based on an unfractured vertical well and infinite-acting reservoir model. The unfractured vertical well and infinite-acting reservoir model is generally applicable to early data points for most well types and boundary conditions. Thus, the first step in this analysis is common to the analysis of wells in this category. On the other hand, the second (or subsequent) step involves a decline curve analysis specific for the actual well and reservoir configuration of the system.

Methods in the second category are applicable to: (1) situations in which no sand face flowing pressure is available for any production data flow rate points, (2) situations in which the sand face flowing pressures cannot be estimated directly from the bottom hole or well head flowing pressures (e.g., due to non-negligible completion pressure losses), or (3) situations involving an unfractured vertical well in an infinite-acting reservoir. Under any of these three conditions, an initial analysis of the early transient (infinite-acting reservoir response) production data on an unfractured vertical well infinite-acting reservoir decline curve set is required. This initial analysis is performed regardless of the actual well type. With the first two situations listed above, this initial step is necessary in order to reduce the number of unknowns in the problem by one, i.e., one parameter, typically the reservoir effective permeability, is estimated in the initial analysis.

For the first condition in the second category, none of the necessary sand face flowing pressures are available for a convolution analysis. According to one embodiment of the invention, the formation effective permeability (k) may be obtained by comparing a first curve that describes the well flow rate as a function of its cumulative production with a second curve that describes a dimensionless flow rate as a function of the dimensionless cumulative production. Because these two functions differ by a constant that corresponds to the formation effective permeability (k), these two curves differ in their ordinate scales when they are plotted on the same graph. The formation effective permeability (k) can then be deduced, for example, by adjusting the ordinate scales of the dimensionless flow rate function so that it matches that of the dimensional counterpart. In this type of analysis, only the early transient (infinite-acting reservoir behavior) is used in determining the appropriate decline curve match.

It is important to note that for any point on the matched decline curve, the pressure drop (or pseudopressure drop for gas reservoir analyses) appears in the denominator of the dimensionless flow rate and cumulative production (i.e., the ordinate and abscissa values), respectively. Therefore, for any point on the decline curve, the abscissa and ordinate scale values may be used to resolve the remaining unknowns in the problem that are directly related to the scales of the two plotting functions, because the pressure drop term cancels out in the evaluation. This principle applies to the initial infinite-acting reservoir unfractured vertical well decline curve analysis for all three conditions listed in the second category. It is also important to note that the abscissa variable (e.g., dimensionless cumulative production) in this particular analysis is referenced to the actual wellbore radius ($r_w$) that is known, not the apparent or effective wellbore radius that is unknown. Radial flow steady-state skin effect is the other variable that can be obtained directly from the matched decline curve stem on the graph in this analysis.

For the first condition in the second category, the formation effective permeability is generally the only parameter estimate that is used in subsequent computations. In contrast, the steady state skin effect is generally not a good way to characterize that behavior unless the well is actually an unfractured vertical well. The transient behavior of vertically fractured or horizontal wells is best characterized using the specific dimensionless parameters associated with those well types (i.e., $C_{fD}$, $L_D$, $r_{wD}$, $Z_{wD}$).

The second condition in the second category also requires an initial analysis of the production data with a set of infinite-acting reservoir unfractured vertical well decline curves to obtain an initial estimate of the reservoir effective permeability so that the completion pressure losses and corresponding sand face flowing pressures may be computed. Once again, the reservoir effective permeability is generally the only parameter from this analysis step that is used in the subsequent calculations.

For the last condition of the second case (unfractured vertical well in an infinite-acting reservoir), all of the analysis results (i.e., reservoir effective permeability and the matched radial flow steady-state skin effect) obtained in the first step curve matching are used. The reservoir effective permeability and the matched radial flow steady-state skin effect values resulting from the analysis represent the final results for those parameters. Once this graphical analysis step is completed, the production data analysis is also completed for the unfractured vertical well and infinite-acting reservoir case.

Category 1

Figure 4:
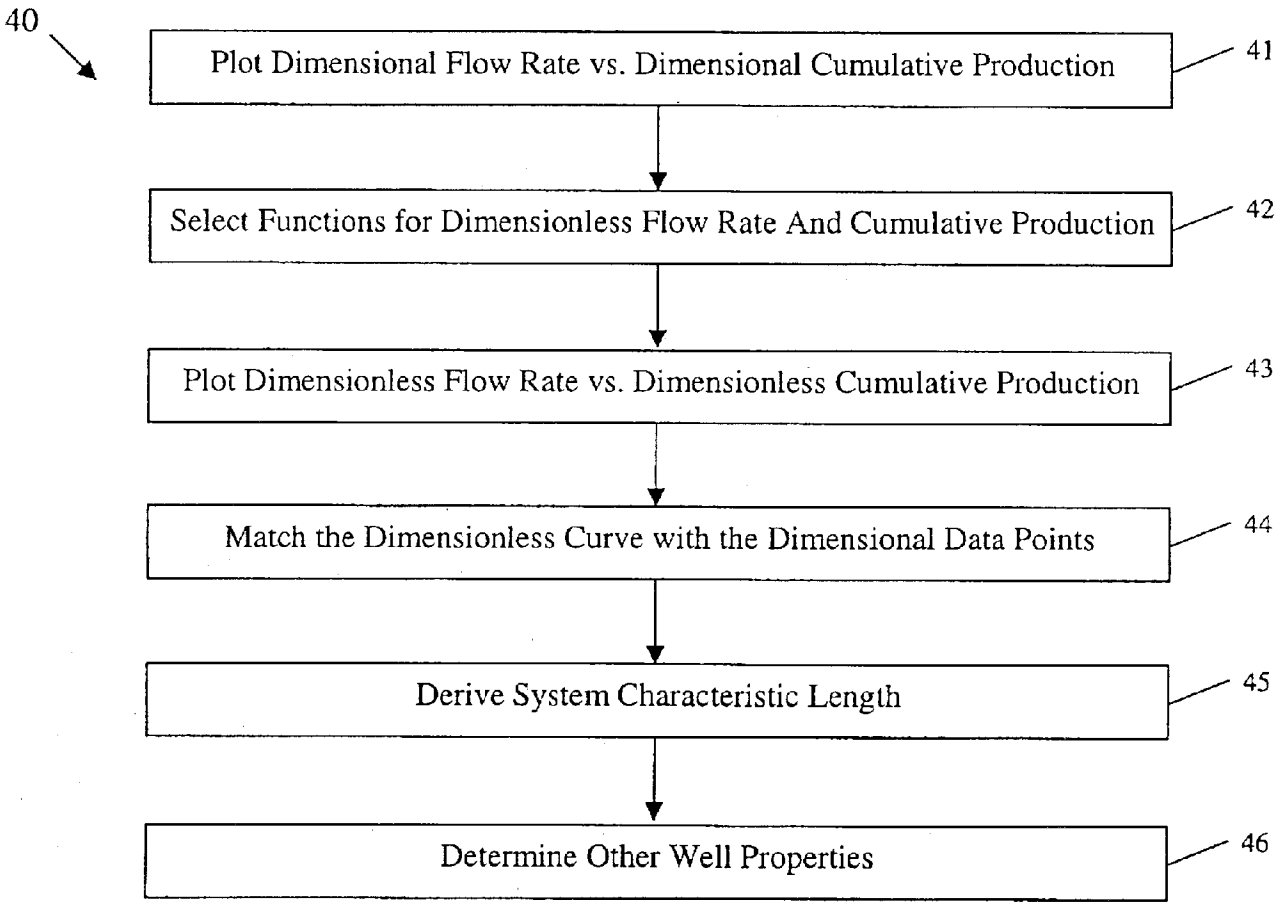
FIG. 4 shows a flow chart of a method in accordance with one embodiment of the invention.

The production analysis procedure that is used for the first case is accomplished in a very straightforward manner. As shown in FIG. 4, according to one method 40 of the invention, the dimensional flow rates of the well versus the dimensional cumulative production are first plotted on a log-log chart (step 41), i.e., plotting the dimensional flow rates of the well against the dimensional cumulative production at each of the production data time levels on a log-log chart. Then, proper functions for the dimensionless flow rate and the dimensionless cumulative production are selected based on the actual reservoir type, the outer boundary conditions, and the well type of interest (step 42). A curve representing the dimensionless flow rate as a function of the dimensionless cumulative production is then plotted on the same log-log chart (step 43). Finally, the ordinate scale of the dimensionless curve is adjusted such that the curve best matches the dimensional data points on the graph (step 44). The curve matching may be accomplished with any method known in the art, for example, by least square fit. One of ordinary skill in the art would appreciate that the above description is for illustration only and other variations are possible without departing from the scope of the invention. For example, it is also possible to plot these curves on a semi-log or linear chart. Furthermore, the procedures could be implemented as numerical computation and no graph needs to be generated.

For each of the production data points that have known sand face flowing pressure values, the reservoir effective permeability may be directly determined from the matched decline curve values, i.e., from the production data, and the relationship between the dimensional and dimensionless well flow rates (ordinate values) (step 44). In some embodiments, the system characteristic length ($L_c$) may also be directly computed from the relationship between the dimensional and dimensionless cumulative production (abscissa values) (step 45). Therefore, independent estimates of these parameters can be determined for each and every production data point for which the sand face flowing pressure is known.

While it might seem possible to evaluate how each of these parameters changes with time, this is not the case for two reasons: (1) the convolution integral as employed in this analysis does not permit the use of a non-linear function (reservoir model), which would be implied if either of these parameters change with time, and (2) the rate-transient decline curve solutions used in the analysis have been generated for constant system properties. Therefore, the formation effective permeability (k) and the system characteristic length ($L_c$) derived from a plurality of data points having sand face flowing pressure in the production history are just independent estimates of these two parameters and they may be averaged to produce representative values for these parameters. Statistical analysis techniques may be included in the averaging process to minimize the effects of outliers in the computed results for these parameters.

With the reservoir effective permeability (k) and system characteristic length ($L_c$) known from the analysis described above, the other well and reservoir properties may then be determined from the dimensionless parameters associated with the matched dimensionless solution decline curve stem (step 46). The precise procedures involved in the determination of these other well and reservoir properties would depend on the well types and the boundary conditions.

For example, an unfractured well in a closed cylindrically bounded reservoir has decline curve stems that are associated with the dimensionless well drainage radius, referenced to the system characteristic length. Therefore, the well's effective drainage radius and drainage area can be readily computed from the match result. The radial flow steady-state skin effect may also be directly obtained from the matched system characteristic length and the wellbore radius using the effective wellbore radius concept.

It should be noted that for the closed finite reservoir decline curve analyses, the decline curve sets displayed on the graphs that are used for the matching purposes may be modified using the appropriate pseudo-steady state coupling relationship for the well model of interest, analogous to the method proposed Doublet and Blsingame. See Doublet, L. E. and Blasingame, T. A., "*Evaluation of Injection Well Performance Using Decline Type Curves*," paper SPE 35205 presented at the 1995 SPE Permian Basin Oil and Gas Recovery Conference, Midland, Tex., March 27–29. With this modification, all of the boundary-dominated flow regime decline data of the decline curves in the set collapse to a single decline stem on the displayed graph and the graphical matching is greatly simplified.

Similarly, for vertically fractured wells in closed rectangularly bounded reservoirs, the decline curve stems correspond to specific values of the dimensionless fracture conductivity and the dimensionless drainage area of the well. The dimensional fracture conductivity may be computed from the matched dimensionless fracture conductivity, the average estimates of the reservoir effective permeability, and fracture half-length (which is equal to the matched system characteristic length). The well drainage area may be directly computed from the matched dimensionless well drainage area ($A_D$) and the system characteristic length.

A similar scenario exists for the production analysis of a horizontal well in a closed finite reservoir. In this case, the decline stems correspond to values of the dimensionless wellbore length in the pay zone (referenced to the net pay thickness), the dimensionless well effective drainage area, the dimensionless well vertical location in the pay zone (if this parameter is considered as variable in the analysis), and the dimensionless wellbore radius. The total effective length of the wellbore in the pay zone may be computed as an average of twice the matched system characteristic length and the value of effective wellbore length derived from the matched dimensionless wellbore length and the net pay thickness. The effective wellbore radius is computed from the matched dimensionless wellbore radius and the net pay thickness. The well effective drainage area is readily obtained from the matched dimensionless drainage area and the system characteristic length.

Category 2

Figure 5:
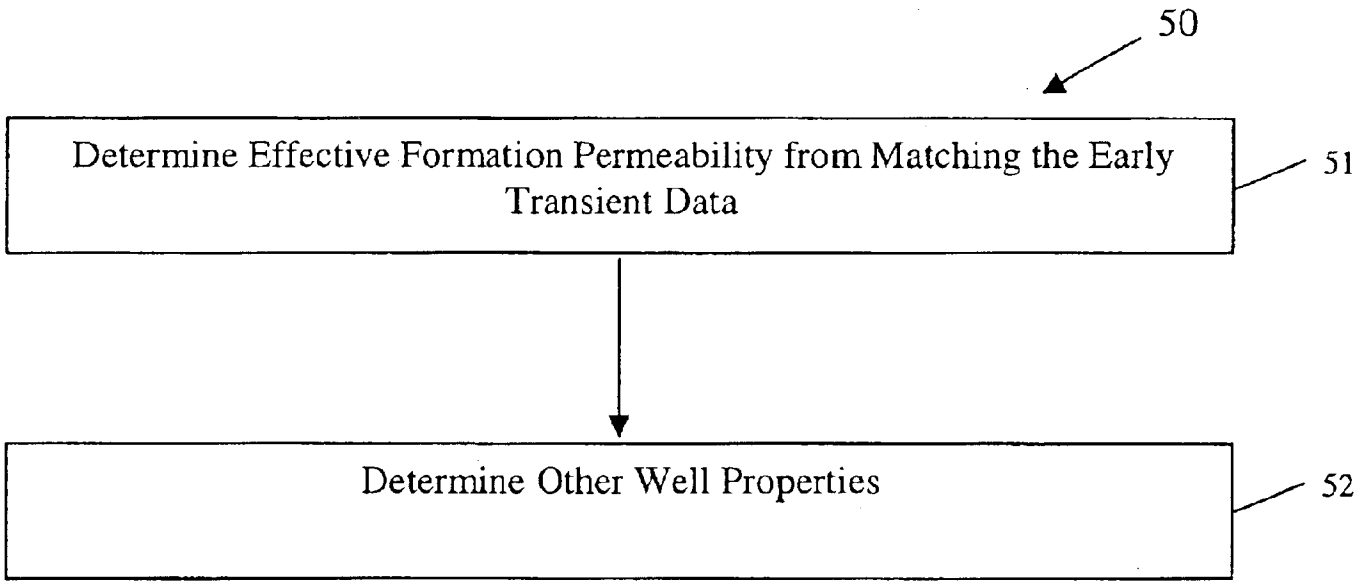
FIG. 5 shows a flow chart of a method in accordance with one embodiment of the invention.

As shown in FIG. 5, the analysis 50 for wells belonging to the second category according to embodiments of the invention requires a two-step or iterative procedure. The initial analysis step involves matching the early transient data (infinite-acting reservoir behavior) of the actual well on an infinite-acting reservoir unfractured vertical well decline curve set (step 51). As noted above, using only the early transient data, this step is generally applicable to various well types and boundary conditions. This step is used to determine an initial estimate of the formation effective permeability (k). Once the formation effective permeability (k) is estimated, it is then used in the second step or the subsequent steps in an iterative procedure to determine other well or reservoir properties based on the specific well types and boundary conditions (step 52).

As noted above, methods in the second category are suitable for three situations. For the first situation, where none of the flowing pressures are known in the production history, the method 50 shown in FIG. 5 may be the only practical way of reliably estimating the reservoir effective permeability independently from the effects of all other parameters governing the rate-transient response of the system. If this situation is applicable in the production analysis, only estimates of the well and reservoir properties can be obtained from the analysis (shown as step 52) because all subsequent computations for the other parameter estimates are dependent on the accuracy of the reservoir effective permeability estimate obtained in the first step (step 51).

This point may appear to be of minor significance. However, in a vertically fractured well that exhibits only bilinear or pseudolinear flow (or all transient behavior prior to the onset of pseudoradial flow) in the production data record, the apparent radial flow skin effect exhibited by the system is transient, i.e. it changes continuously with time. The flux distribution in the fracture does not stabilize until the pseudoradial flow regime appears in the transient behavior of the well. Until the flux distribution in the fracture stabilizes, the transient behavior of the vertically fractured well cannot be characterized by a meaningful and constant steady-state radial flow apparent skin effect. Prior to that point in time, the production rate decline on the graph may not follow a single transient decline stem that is characterized by a constant radial flow skin effect. However, despite this limitation, it has been found, by matching numerous sets of numerical simulation transient production results of fractured wells, that production data analysis according to the above procedure generally produces reliable reservoir effective permeability (k) estimates, typically with less than 5% error.

Because the early transient behavior of low dimensionless conductivity ($C_{fD}$<10) vertical fractures may not follow a single constant skin effect decline stem on the decline analysis graph for the the unfractured vertical well and infinite-acting reservoir, the skin effect derived from the analysis may not be appropriate for characterizing the transient behavior of the well. For higher dimensionless conductivity ($C_{fD}$>50) fractures, the early transient production decline data do tend to follow a single decline stem. However, in general only the estimate of the reservoir effective permeability is used in the subsequent analyses of the production data and the remaining well and reservoir specific parameters of interest are obtained using a decline curve analysis that corresponds to those particular well and reservoir conditions.

A similar analysis applies to the early transient behavior of horizontal wells, with their model specific early transient flow regimes. In this case, the reservoir effective permeability is also the only parameter estimate obtained from the initial unfractured vertical well and infinite-acting reservoir decline curve analysis.

Once the reservoir effective permeability has been estimated from the initial analysis step described above (step 51 in FIG. 5), the production data are then plotted on a decline curve set for the actual well and reservoir conditions of interest. With the previously determined reservoir effective permeability (k) estimate, the only unknown remaining unresolved between the dimensionless parameter scales of the reference decline curve set and the dimensional production data is the system characteristic length ($L_c$), which is associated with the abscissa scale of each of the matched production data points.

As noted above, at each production data point on the matched decline curve stem of the graph, the pressure (or pseudopressure) drop terms are present in the definitions of both the dimensionless flow rate and cumulative production variables (i.e., ordinate and abscissa) and they cancel out when resolving the ordinate and abscissa match points of the dimensionless and dimensional scales for each of the matched points. Therefore, independent estimates of the system characteristic length may be directly evaluated for each of the actual production data flow rate points. Furthermore, as noted above, a statistical analysis of the independent estimates of the system characteristic length may also be included to obtain a representative average value for this parameter.

With estimates of the reservoir effective permeability (k) and system characteristic length ($L_c$) obtained in the manner described above, the remaining unknowns of the decline curve production analysis are obtained in the same manner as previously described for situations in the first category (shown as step 46 in FIG. 4).

For the third situation in the second category, where the well is actually an unfractured vertical well and the reservoir is still infinite-acting at the end of the historical production data record, the analysis may be repeated using the infinite-acting reservoir unfractured well decline curve set to improve the estimates of the reservoir effective permeability and steady state skin effect.

For the first and second situations in the second category, an iterative procedure may be used to update the parameter estimates used in the completion loss and sand face pressure calculations, whether these are measured values (situation 2) or computed values (situations 1 and 2) as detailed in the following section. The iterative matching process for this case and these conditions uses a reference dimensionless decline curve set that corresponds to the actual well and reservoir type considered. The iterative matching and analysis process are continued until convergence and a satisfactory decline analysis match are achieved.

With the graphical analysis matching, the sand face flowing pressure history of the well may be computed in a systematic point-by-point manner (beginning with the initial production data point) by resolution of the matched dimensionless decline curve stem solution (and the corresponding dimensionless time scale associated with that curve) and the superposition relationships given in Eqs. 4 and 5. Definitions of the dimensionless variables used in these relationships have been given previously in Eqs. 6 through 13.

Note that the procedure for estimating the sand face flowing pressures at each of the production data flow rate points is applicable to all well and reservoir types and can be performed regardless of whether any historical measured well flowing pressures are available. If some sand face pressures are known (such as in the first case discussed), a direct comparison of the actual and computed sand face flowing pressure values can be used to verify the quality of the decline curve match obtained for the production data set. The wellbore bottom hole flowing pressures can also be back-calculated from the computed sand face flowing pressure history by including the completion losses of the system. Examples of such calculation may be found in *The Technology of Artificial Lift Methods*, Brown, K. E. (ed.), 4 PennWell Publishing Co., Tulsa, Okla. (1984).

FIELD EXAMPLES AND DISCUSSION

Embodiments of the invention have been tested and validated with numerous synthetic (simulated) examples. However, the utility and robustness of the production analysis models according to embodiments of the invention is best demonstrated with field examples. Field examples provide an additional complexity in the analysis due to the fact that the production performance data of the wells are often not recorded under ideal conditions. The following describes two field examples, for which independent estimates of the well and reservoir properties are available, to demonstrate some of the advantages and capabilities of the production analysis techniques in accordance with the invention. The independent estimates of these properties are derived from conventional production analyses or geophysical measurements such as core analyses.

The first example selected is a vertically fractured gas well located in South Texas for which a complete flowing tubing pressure record is available, which permits a conventional convolution analysis of the production performance of the well to evaluate the well and reservoir properties. The second example is an unfractured vertical well completed in a heavy oil reservoir in South America (produced with an electrical submersible pump (ESP) for which no pump intake pressures were recorded) that has a fairly complete set of laboratory core analyses from whole cores.

Figure 6:
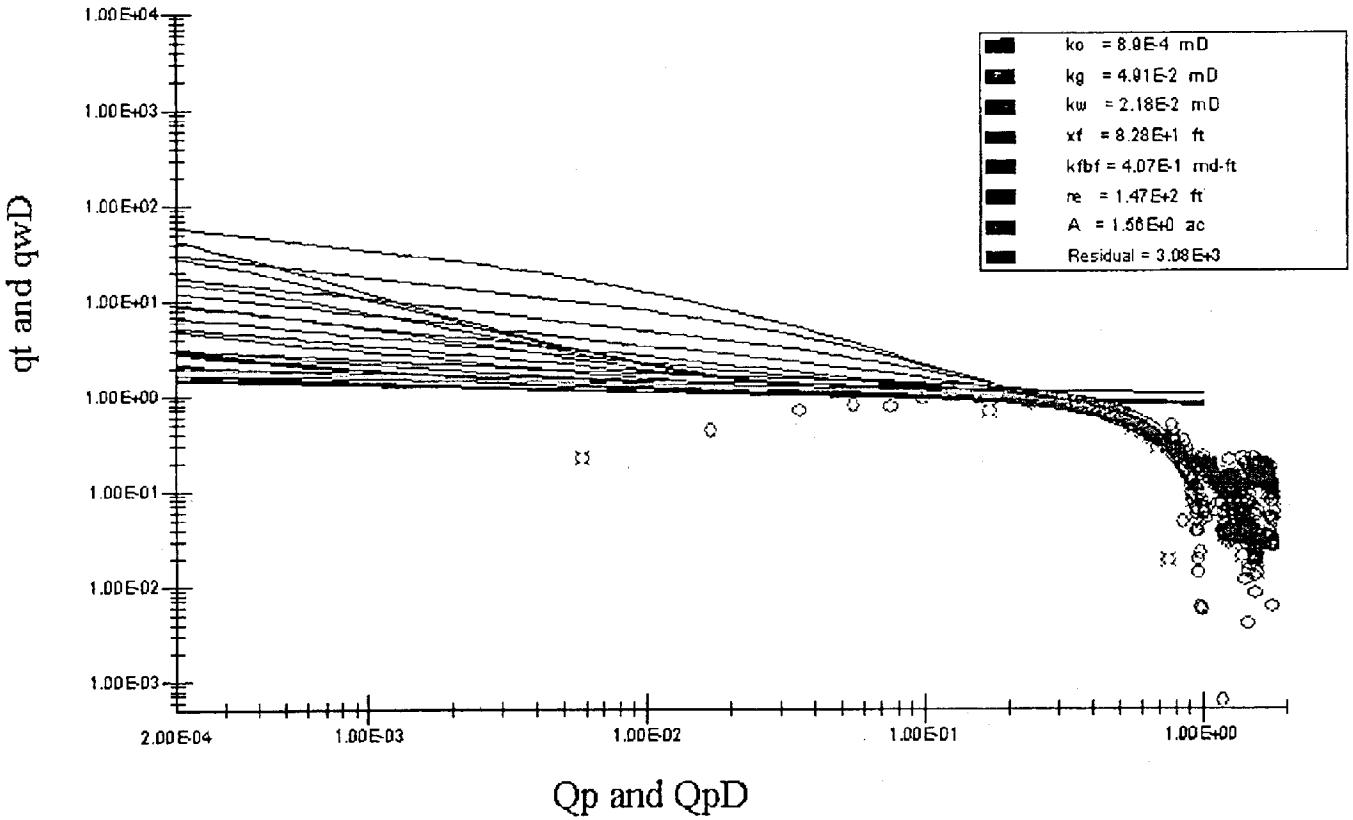
FIG. 6 shows a graph of well analysis according to one embodiment of the invention.

FIG. 6 shows a decline curve match of the first well, as analyzed with a prior art production analysis history matching model. This analysis produced estimates of the reservoir effective permeability, fracture half-length, and conductivity of 0.05 md, 80 ft, and 0.5 md-ft, respectively. Also shown is a curve 2, which is from an analysis using a production analysis model in accordance with embodiments of the invention. This analysis provides essentially the same results ($k_g$=0.049 md, $X_f$=83 ft, $k_fb_f$=0.41 md-ft) as those from the production analysis using the conventional rate-transient convolution analysis.

Figure 7:
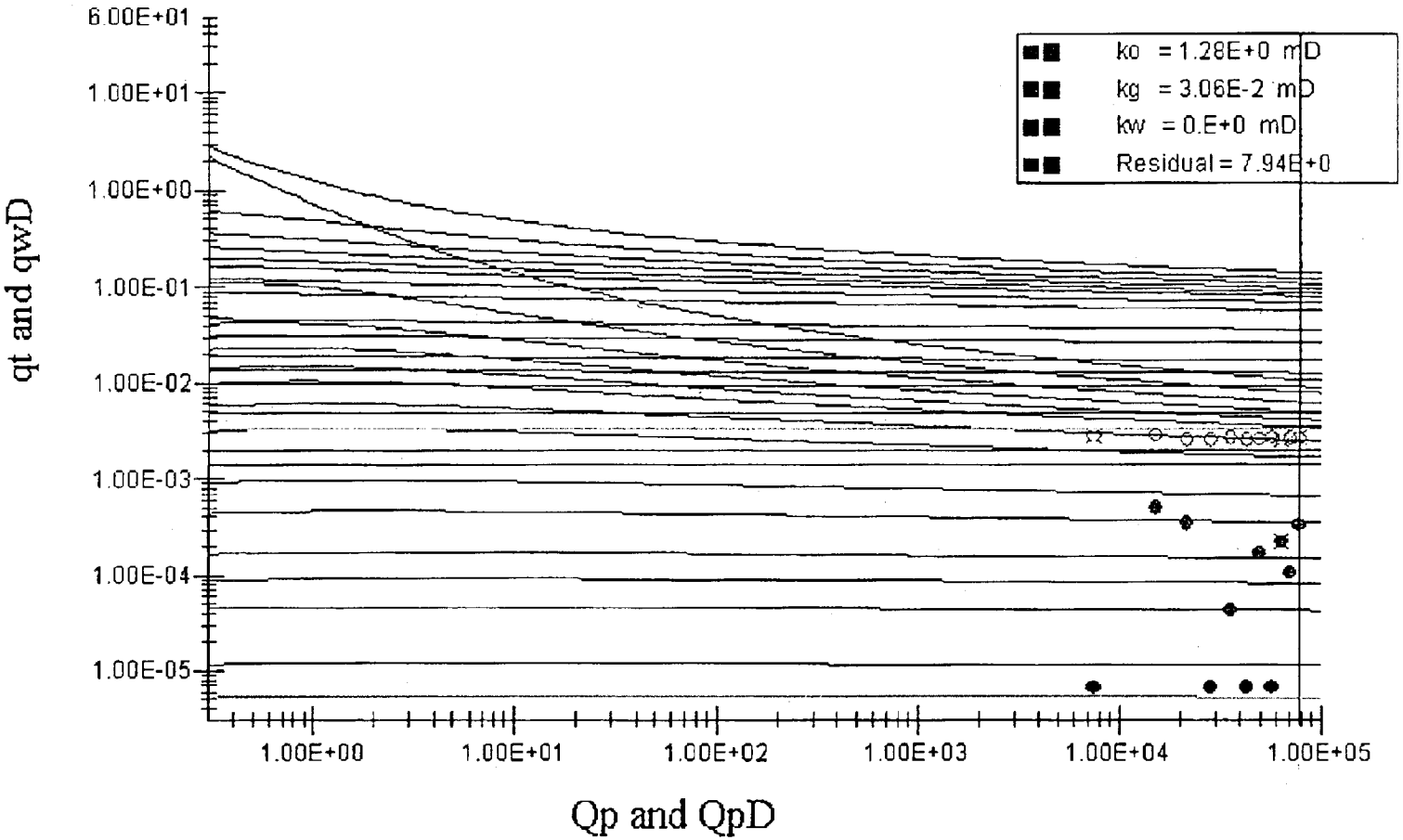
FIG. 7 shows a graph of well analysis according to one embodiment of the invention.

The second field example (an oil well with absolutely no measured well flowing pressures) production analysis required the two-step decline analysis of the production data, according to the method shown in FIG. 5. FIG. 7 is the decline curve analysis of the early transient (infinite-acting reservoir) production performance of the well used to determine the estimate of the reservoir effective permeability (step 51 in FIG. 5). The production analysis resulted in an estimate of the average reservoir effective permeability of 1.28 md, which is in excellent agreement with the average permeability of 1.4 md obtained from core analyses. Thus, the production data analysis methodology in accordance with the invention was able to reliably estimate the in situ reservoir effective permeability from the production behavior of a well with absolutely no measured well flowing pressures. In contrast, a conventional convolution analysis of the production performance of this well would not be possible.

Figure 8:
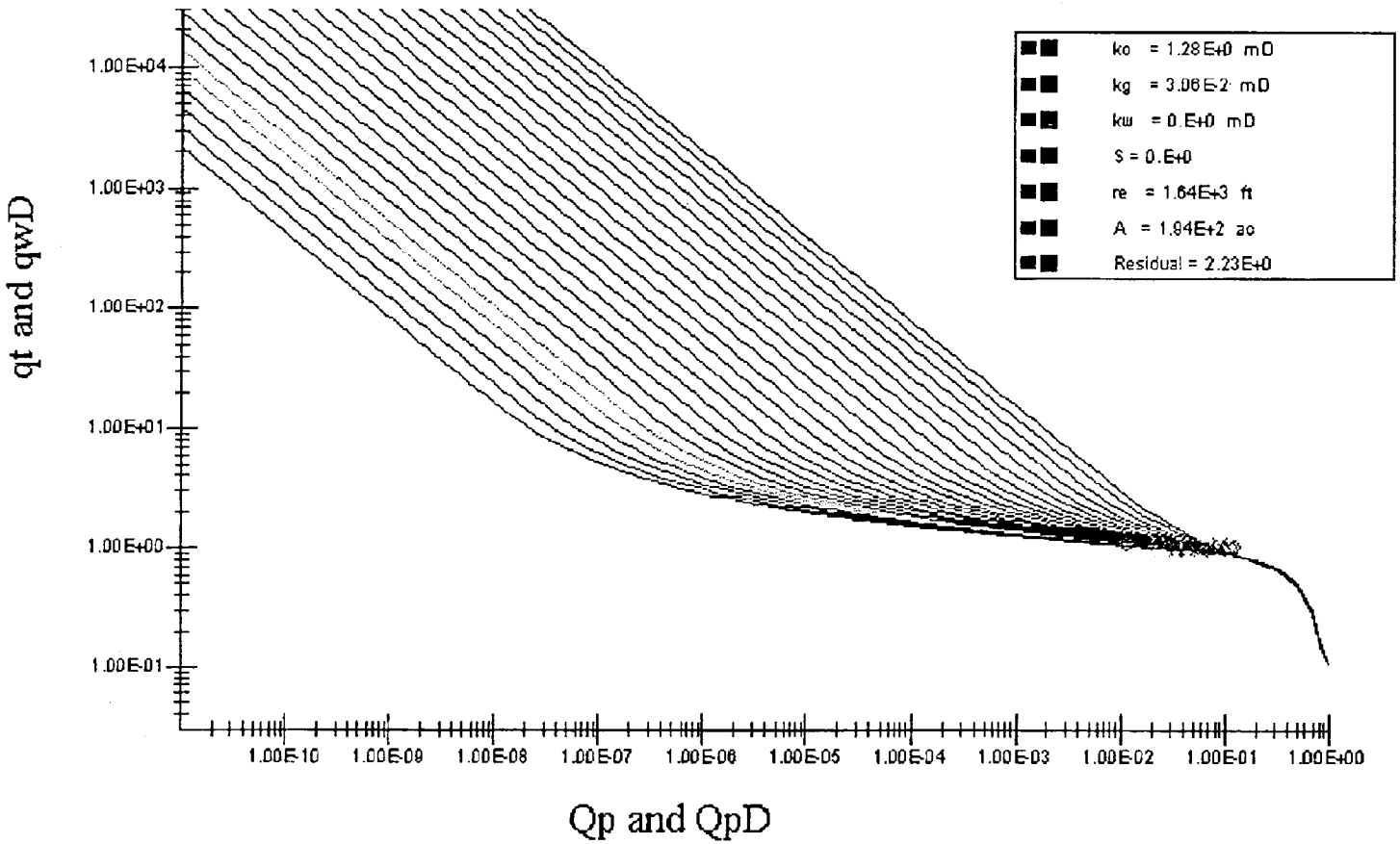
FIG. 8 shows a graph of well analysis according to one embodiment of the invention.

The second step (step 52 in FIG. 5) in decline curve analysis for the second field example is depicted in FIG. 8. This graph illustrates a decline analysis matching for evaluating the radial flow steady state skin effect and an estimate of the effective well. drainage area. There is no independent estimate of the steady state skin effect available for comparison. However, the inverted estimate of skin effect is consistent with the well completion type and performance. The effective well drainage area estimate obtained from the analysis according to embodiments of the invention is 194 acres, which is also in good agreement with the well spacing of about 200 acres on which the wells in this field have been drilled.

While the above description and analyses use graphs to illustrate methods of the invention, one of ordinary skill in the art would appreciate that these procedures can be implemented as numerical computation and no graphs need to be actually generated.

Some embodiments of the invention may be implemented in a program storage device readable by a processor, for example computer 23 shown in FIG. 1. The program storage device may include a program that encodes instructions for performing the analyses described above. The program storage device, which may take the form of, for example, one or more floppy disks, a CD-ROM or other optical disk, a magnetic tape, a read-only memory chip (ROM) or other forms of the kind that would be appreciated by one of ordinary skill in the art. The program of instructions may be encoded as "object code" (i.e., in binary form that is executable more-or-less directly by a computer), in "source code" that requires compilation or interpretation before execution or in some intermediate form such as partially compiled code.

Advantages of the invention include the following. The production analysis techniques according to the invention provide for the first time a truly mathematically correct, internally-consistent, and practical means of effectively performing a convolution analysis of these types of production analysis problems to permit the estimation of the well and reservoir properties. The production analysis techniques in accordance with the invention do not require that the sand face flowing pressures be known for each of the production data points plotted on the graph. This eliminates most problems encountered in conventional convolution analyses related to partial day or partial month production in the production data record. If the well is only on production for part of a day (or month if monthly production data are used), it is often not readily apparent how to choose an average flowing pressure to assign to that production data point and time value in the conventional convolution analysis.

In addition, with the production analysis techniques of the invention, values of the well flowing pressure need not be guessed or estimated for the missing pressure values to complete the convolution analysis of the production data. It is also readily apparent from the theory provided in the Appendix and from the oil well ESP example described above, that the production analysis technique according to one embodiment of the invention results in an effectively rigorous convolution analysis of the production data, even with no sand face flowing pressures for the production data analysis.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for evaluating well performance, comprising;

deriving a reservoir effective permeability estimate from data points in a production history, wherein the data points include dimensional flow rates and dimensional cumulative production, at least one of the data points has no sand face flowing pressure information; and deriving at least one reservoir or well property from the reservoir effective permeability estimate and the data points according to a well type and a boundary condition for a well that produced the production data.

2. The method of claim 1, wherein the deriving comprises fitting a curve representing dimensionless flow rates as a function of dimensionless cumulative production to a plot of dimensional flow rates versus dimensional cumulative production from the data points.

3. The method of claim 1, wherein the deriving is performed using early data points that fit a model of an unfractured vertical well having an infinite-acting reservoir behavior.

4. The method of claim 1, wherein the deriving is performed by fitting a curve representing dimensionless flow rates as a function of dimensionless cumulative production to a plot of dimensional flow rates versus dimensional cumulative production.

5. A method for evaluating well performance, comprising;

deriving dimensionless flow rates and dimensionless cumulative production from dimensional flow rates and dimensional cumulative production data in a production history, wherein at least one data point in the production history includes pressure information and the deriving is based on a well type and a boundary condition;

fitting a curve representing the dimensionless flow rates as a function of the dimensionless cumulative production to a plot of the dimensional flow rates versus the dimensional cumulative production; and obtaining a formation effective permeability estimate from the fitting.

6. The method of claim 5, further comprising deriving a system characteristic length from the fitting.

7. The method of claim 6, further comprising deriving a skin effect from the fitting.

8. The method of claim 6, further comprising deriving at least one additional well property based on the formation effective permeability estimate.

9. The method of claim 8, wherein the at least one additional well property comprises one selected from the group consisting of a well drainage radius, an effective fracture length, well drainage area, radial flow steady-state skin effect, fracture conductivity, apparent wellbore radius, effective wellbore length in the pay zone, and all other well and reservoir parameters that are pertinent to the model being considered.

10. The method of claim 6, wherein the well type comprises one selected from the group consisting of an unfractured well, a vertically fractured well, and a horizontal well or any other conceivable practical well completion types that are now or can be used to complete the well in the productive formation for the extraction of reservoir fluids.

11. The method of claim 6, wherein the boundary condition and drainage area shapes comprises one selected from the group consisting of cylindrical boundary, rectangular and with outer boundary conditions that may include infinite-acting, noflow (closed), or constant pressure outer boundary conditions.

12. The method of claim 6, wherein the fitting is performed by a statistical method.

13. The method of claim 6, wherein the pressure information is one selected from the group consisting of a sand face flowing pressure, a well head flowing pressure, and a bottom hole flowing pressure.

14. The method of claim 8, wherein the well type is an unfractured well and the boundary condition is a closed cylindrical boundary, and wherein the at least one additional well property comprises a dimensionless well drainage radius.

15. The method of claim 8, wherein the well type is vertically fractured well and the boundary condition is a closed rectangular boundary, and wherein the at least one additional well property comprises one selected from the group consisting of a dimensionless fracture conductivity and a dimensionless drainage area.

16. The method of claim 8, wherein the well type is a horizontal well and the boundary condition is a closed finite boundary, and wherein the at least one additional well property comprises one selected from the group consisting of a dimensionless effective wellbore length in the pay zone, a dimensionless well effective drainage area, a dimensionless well vertical location in the pay zone, and a dimensionless wellbore radius.

17. A method for evaluating well performance, comprising;

deriving a reservoir effective permeability estimate from early data points in a production history, the data points include dimensional flow rates and dimensional cumulative production, wherein no data point in the production history has sand face flowing pressure information, and the deriving is based on a model of an unfractured vertical well having an infinite-acting reservoir; and deriving at least one reservoir property from the reservoir effective permeability estimate and the production data according to a well type and a boundary condition for a well that produced the production data.

18. The method of claim 17, wherein the at least one reservoir property comprises one selected from the group consisting of a well drainage radius, well drainage area, radial flow steady-state skin effect, effective fracture length, fracture conductivity, apparent wellbore radius, effective wellbore length in the pay zone, and all other well and reservoir parameters that are pertinent to the model being considered.

19. The method of claim 17, wherein the well type comprises one selected from the group consisting of an unfractured well, a vertically fractured well, and a horizontal well or any other conceivable practical well completion type for thich the dimensionless rate-transient ($q_{wD}$ and $Q_{pD}$ versis $t_D$) can be generated.

20. The method of claim 17, wherein the boundary condition drainage area shapes comprises one selected from the group consisting of cylindrical boundary, rectangular boundary, and with outer boundary conditions that may include infinite-acting, noflow (closed), or constant pressure outer boundary conditions.

21. A system for evaluating well performance, comprising;

a computer having a memory for storing a program, wherein the program includes instructions to perform:

deriving a reservoir effective permeability estimate from data points in a production history, wherein the data points include dimensional flow rates and dimensional cumulative production, at least one of the data points has no sand face flowing pressure information; and deriving at least one reservoir or well property from the reservoir effective permeability estimate and the data points according to a well type and a boundary condition for a well that produced the production data.

* * * * *